United States Patent [19]

Shimada et al.

[11] 4,357,403

[45] Nov. 2, 1982

[54] PHOTOCONDUCTIVE PLATE FOR PRINTING AND A METHOD FOR THE PREPARATION OF A PRINTING PLATE BY HEATING

[75] Inventors: Fumio Shimada, Fussa; Kinu Hiruma, Tachikawa, both of Japan

[73] Assignee: Konishiroku Photo Industry Co., Ltd., Japan

[21] Appl. No.: 176,184

[22] Filed: Aug. 7, 1980

[30] Foreign Application Priority Data

Aug. 8, 1979 [JP] Japan ..... 54-100165

[51] Int. Cl.[3] ..... G03G 13/32

[52] U.S. Cl. ..... 430/18; 430/17; 430/49; 430/97; 430/330; 101/467; 101/470; 427/372.2

[58] Field of Search ..... 430/49, 97, 130, 136, 430/302, 330, 56, 11, 17, 18; 101/467, 470; 427/372.2

[56] References Cited

U.S. PATENT DOCUMENTS

| | | | |
|---|---|---|---|
| 3,121,009 | 2/1964 | Giaimo | 430/49 |
| 3,230,081 | 1/1966 | Tomanek et al. | 430/49 |
| 3,305,359 | 2/1967 | Delmont | 430/49 |
| 3,615,385 | 10/1971 | Lind | 430/49 |
| 3,745,002 | 7/1973 | Honjo et al. | 430/49 |

*Primary Examiner*—Roland E. Martin, Jr.
*Attorney, Agent, or Firm*—Finnegan, Henderson, Farabow, Garrett & Dunner

[57] ABSTRACT

A photoconductive plate for printing use having imaged and non-imaged portions. The plate comprises an electroconductive support and a photoconductive layer including a photoconductive material comprising an organic photoconductive pigment and a binder comprising an alkaline soluble phenol resin. The photoconductive plate is subjected to heat treatment at a sufficiently elevated temperature prior to removal of portions of the photoconductive layer so that at least 80% by volume of the non-imaged portion of the photoconductive layer is removed when the photoconductive plate is subjected to treatment with a removing solution. A method for preparing a printing plate. An image is formed on a photoconductive layer and the non-imaged portion of the photoconductive layer is removed by treating the layer with a removing solution. The photoconductive plate is subjected, prior to removal of the non-imaged portion of the photoconductive layer, to an elevated temperature sufficient so that at least 80% by volume of the photoconductive layer is removed in the non-imaged portion when the photoconductive layer is treated with a removing solution.

8 Claims, 1 Drawing Figure

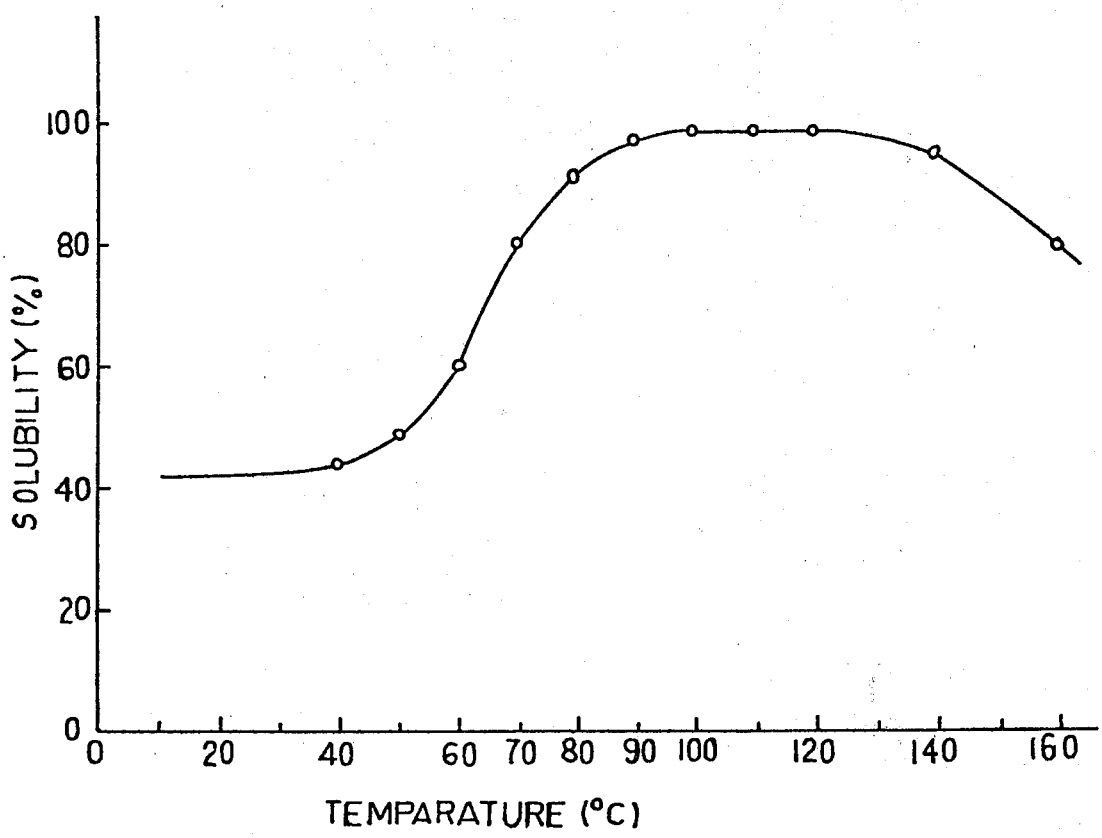
SOLUBILITY (%)
100
80
60
40
20
0
0
20
40
60
70
80
90
100
120
140
160
TEMPARATURE (°C)

PHOTOCONDUCTIVE PLATE FOR PRINTING AND A METHOD FOR THE PREPARATION OF A PRINTING PLATE BY HEATING

The present invention relates to a photoconductive plate for printing use and a method for the preparation of a printing plate by using the same. More particularly the invention relates to a photoconductive plate for printing use by the use of which the occurrence of fog caused by remaining dye in non image portion can affectively be inhibited, and thus it will become possible to provide a highly sensitive printing plate having excellent printing fidelity and printing durability.

As for original plate for printing use utilizing electrophotography, such zinc oxide-resin dispersed type offset printing plates are heretofore known as are disclosed in Japanese Patent Examined Publications No. 47610/1972, 40002/1973, 18325/1973, 15766/1973 and 25761/1976, and this type of plate is used, after a toner image is formed by electrophotographic method, by being moistened with oil insensitizing solution (e.g., acid solution containing ferrocyanic salt or ferricyanic salt) in order to oil-insensitize the non-image portion of the plate. Printing durability of such offset printing plate treated and formed as above is approximately 5,000–10,000 and is not suitable to print more than that number and this type of printing plate has such disadvantages that its electrostatic characteristics tend to become degraded if it is composed suitably for oil-insensitization, and the image quality is worsen.

And, in such organic photoconductor-resin type original plates as disclosed in Japanese Patent Examined Publications No. 17162/1962, 7758/1963 and 39405/1971 and Japanese Patent Publication Open to Public Inspection No. 2437/1977, etc., a photosensitive member is made by coating on the surface of ground aluminium plate a photoconductive layer which is made by binding oxazole or oxadiazole with styrenemaleic acid anhydride copolymer, and a toner image is formed on said photosensitive member by means of electrophotographic method and then a printing plate is made by dissolving and removing non-image portion with alkaline solution or organic solvent. The printing plate of this kind has such faults that certain sensitizing agent such as polymethine dye, etc. must be used, and that it does not possess enough sensitivity for practical use in the long wave length range over 600 mμ, even if used with sensitizing agent; for example, it is impossible to carry out an image recording with a low-priced He-Ne laser of semiconductive layer.

As a result of the continuous study to eliminate said faults, the present inventors have previously proposed in Japanese Patent Application No. 42381/1978 an original plate for printing use which comprises a photosensitive layer formed by dispersing electrophotoconductive pigment in phenol resin binder.

Said proposed original plate for printing use has been a novel technology, by means of an electrophotographic method, being capable of eliminating the faults associated with such known original plates as described above. The proposed original plate has the following advantages i.e., it has (1) high sensitivity, (2) sufficient spectral sensitivity suitable for image-recording with He-Ne laser or semiconductive laser which oscillates in near infrared region, (3) excellent electrostatic characteristics such as electric charge retention and moisture resistance, (4) a photoconductive layer capable of being easily dissolved in alkaline solution and (5) it is capable of being charged either in the positive or in the negative so that either positive-negative or negative-positive image can be formed with a single developer (toner).

As a result of further continuous study on said original plate having said various advantages, the present inventors have found that, in said proposed original plate as photoconductive pigment is being dispersed in phenol resin of the photoconductive layer, a small amount of pigment and resin often remain in the non-image portion of the plate, and this phenomenon often gives said original plate unfavorable printing characteristics such as an occurrence of fog, etc.

This phenomenon is observed not only in the photosensitive layer described above, but also in other photosensitive layers which are formed by dispersing or dissolving photoconductive material in an organic binder.

For the purpose of eliminating such an unfavorable phenomenon of the remaining of dye in the layer, such attempts as processing the layer with a strong alkaline solution, repeating etching process or scratching off with a suitable sponge such as planocellulose sponge, etc. have been made, however, such faults are found with such attempts that due to so-called "side edge effect", an image quality often becomes inferior and, as a result, a fine printing can hardly be obtained, and, moreover, it is often the case that its printing durability gets worse.

Accordingly, the first object of the invention is to provide an original plate having a photoconductive layer formed by dissolving or dispersing photoconductive material in an organic binder, with which such an infavorable phenomenon as described above because of remaining of the pigment in non-image portion is effectively prevented from occurring and thereby the occurrence of fog can be restrained.

The second object of the invention is to provide an original plate for printing use with little side edge effect in an image portion as the non-image portion of the photoconductive layer thereof can easily be removed by a conventional removing solution, and with which original printing plate with high fidelity and improved printing durability can be obtained.

The third object of the invention is to provide a method to form a printing plate which is capable of attaining the above mentioned objects.

The fourth object of the invention is to provide a method to form a printing plate with improved dark decay property and developability.

The objects of the invention, particularly the first and second objects, can be attained by making use of an original plate having a potoconductive layer on an electroconductive support, said original plate for printing use is treated by heat so that the percentage of dissolved amount of photoconductive layer to photoconductive layer removing solution can be at 80% or more.

And, the objects of the invention, particularly the third and fourth objects, can be attained by heat treating the original plate for printing use prior to removing said photoconductive layer with the removing solution.

The original plate for printing use in the present invention means a photosensitive plate for printing use which comprises a photoconductive layer containing a photoconductive material and binder on an electroconductive support, and is designated as a photosensitive plate which is prior to the process for removing photoconductive layer by a removing solution.

And the printing plate in the invention means a plate for printing use obtained by removing non-image portion of the photoconductive layer, after an imagewise exposure, using a removing solution.

The original plate for printing use of the invention can be obtained by heat treating the photoconductive layer formed on an electroconductive support before removing said photoconductive layer. The heat treatment may be effected at any time before the removing process, however it is preferable in view of restraining the occurrence of dark decay, etc. to effect this heat treatment at the time of forming a printing plate or thereabout.

The original printing plate of the invention can be obtained, for example, by heating a printing plate defined herein for one minute of time at a temperature ranging from 70° C. to 160° C. as shown in the drawing.

The dissolved amount of 80% in the photoconductive layer to removing solution in the invention means that 80% or more by volume of photoconductive layer of an original plate is dissolved and removed when the removing process is effected to said original plate without effecting electrostatic image-forming process.

As the means for the heat treatment any known heat treating method may be applied. For example, the heating method utilizing either radiant heat for example by means of an infrared heater, etc., conduction of heat, for example by means of a heat roller (such as a heat roller having a high lubricative surface), etc. or heat convection such as hot air blast, etc. can be adopted.

As for the photoconductive materials to be used in the invention, inorganic photoconductors such as zinc oxide, cadmium sulfide, titanium oxide, selenium, cadmium selenide, zinc selenide, lead oxide, etc., or substituted vinyloxazole or other known organic photoconductors may be used. Among them photoconductive organic pigments may preferably be used, particularly phthalocyanine pigments are favorably used.

As phthalocyanine pigments which are conveniently employed in the present invention as photoconductive materials those represented by the following general formula can be mentioned:

General Formula [I]

$$(C_8H_4N_2)R_n$$

wherein, R represents hydrogen atom, deuterium, sodium, potassium, copper, silver, beryllium, magnesium, calcium, zinc, cadmium, barium, mercury, aluminium, gallium, indium, lanthanium, neodium, samarium, europium, dysprosium, holmium, erbium, thulium, ytterbium, vanadium, antimony, chromium, molybdenum, uranium, manganese, iron, cobalt, nickel, rhodium, palladium, osumium and platinum; and n is an integer of 0 to 2.

Among the above, non-metallic phthalocyanine of $\alpha$, $\beta$, $\gamma$, $\pi$, $\chi$ and $\epsilon$ types, or metallic phthalocyanine of copper, nickel, cobalt, lead or zinc, etc. is particularly preferable.

The phthalocyanine pigments including the compounds as shown in said general formula [I], have been described, for example, in the Japanese Patent Examined Publications No. 2780/1965, 8102/1970, 11021/1970, 42511/1971, 42512/1971, 163/1973, 17535/1964, and 5059/1975, and the Japanese Patent Publication Open to Public Inspection No. 38543/1975.

As one of other photoconductive organic materials used in the invention, photoconductive azo pigments as described in the Japanese Patent Publication Open to Public Inspection Nos. 90827/1976 and 55643/1977 for example, which are monoazo pigments as shown in the general formula [II] and disazo pigments in the general formula [III] below, can be mentioned.

General Formula [II]

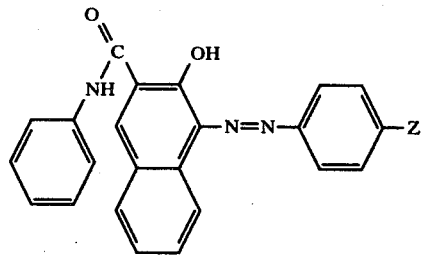

wherein, Z represents an atom or a group such as $-NO_2$, $-CN$, $-Cl$, $-Br$, $-H$, $-CH_3$, $-OCH_3$, $-OC_2H_5$, $-OH$, $-N(C_2H_5)_2$, etc.

General Formula [III]

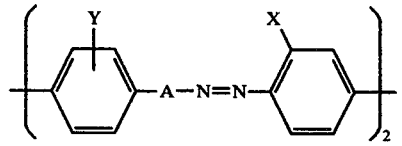

wherein, A has a structure of

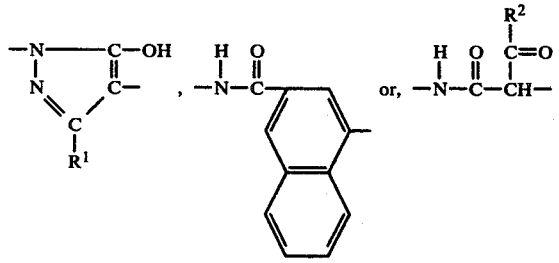

wherein, $R^1$ and $R^2$ independently represent a lower alkyl group. In the above formula [III], X and Y independently represent atom or group such as that of $-NO_2$, $-CN$, $-H$, $-CH_3$, $-OCH_3$, $-OC_2H_5$, $-OH$, $-Cl$, $-Br$, $-N(C_2H_5)_2$, etc.

As for the chemical compounds shown in the above general formula [II] and [III], dian blue which is a kind of disazo pigments is particularly preferable.

As for quinacridone pigments, for example, quinacridone pigments as described in the Japanese Patent Publication Open to Public Inspection No. 30332/1974 which may optionally have a subsituent as shown in the general formula [IV] can be mentioned:

General Formula [IV]

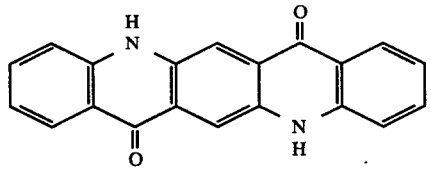

Among the pigments shown in the above general formula [IV], unsubstituted trans-quinoacridones and trans-quinacridones substituted with methyl group or chlorine atom, and those of which are linear trans-quinacridones and $\beta$ and $\gamma$, are particularly preferable.

As for bisbenzimidazole pigments, for example, bisbenzimidazole pigments as described in the Japanese Patent Publication Open to Public Inspection No. 18543/1972 which pigments include trans-type compounds as shown in the general formula [V] and cis-type pigments as shown in the general formula [VI] below are used in the invention.

General Formula [V]

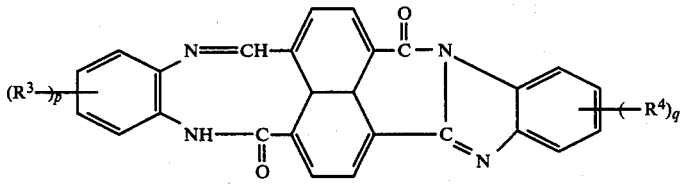

General Formula [VI]

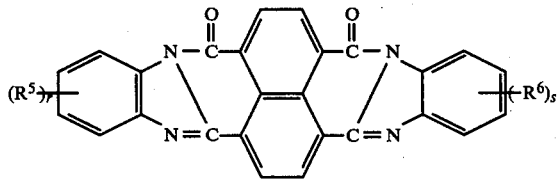

In the above general formula [V] and [VI], $R^3$ and $R^4$, $R^5$ and $R^6$ independently represent substituent selected from the group consisting of an alkyl group which may optionally be substituted, aryl group which may optionally be substituted, halogen atom, nitro group and amino group, p, q, r, s independently represent an integer of 0 to 4 and when either p, q, r or s is 2 or more, said substituents may be the same or different from each other. Further, the substituted groups of $R^3$, $R^4$, $R^5$ and $R^6$ may be fused to form a benzene nucleus.

The pigments having hetero ring which is produced by a reaction of 1,4,5,8-tetracarboxylic acid naphthalene with hetero ring diamine can also be used in the invention.

As for indigo pigments, for example, transindigo pigments as shown in the general formula [VII] described in the Japanese Patent Publication Open to Public Inspection No. 30331/1972, and cisindigo pigments as shown in the general formula [VIII] below can be mentioned:

General Formula [VII]

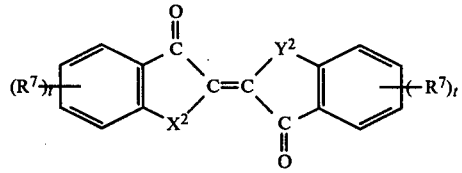

General Formula [VIII]

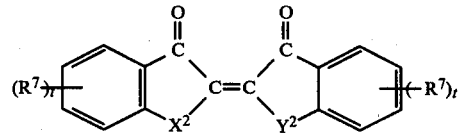

In the above general formulae [VII] and [VIII], $R^7$ represents either one of alkyl group, aryl group, amino group or halogen atom, and $X^2$ and $Y^2$ independently represent a group or atom selected from —NH—, —O—, —S—, —Se— and —Te—, t represents an integer of 1 to 4 and the substituents may be the same or different from with each other. Among them, non-substituted transindigo pigment in which $X^2$ and $Y^2$ are NH group or S atom is particularly preferable.

As for quinone pigment, for example, polycyclic quinone pigment as described in the Japanese Patent Publication Open to Public Inspection No. 18544/1972 is used in the invention, preferably, anthoanthrone, biranthrone, dibenzypyrenequinone, pyrenequinone, 3,4,9,10-dibenzypyrenequinone, brominated anthoanthrone, brominated dibenzpyrenequinone, brominated biranthrone, anthraquinone thiazole, flavanthrone, etc. can be mentioned.

As for perylene pigments, for example, the pigments, as shown in the general formulas [IX] and [X] below, which have been described in the Japanese Patent Publication Open to Public Inspection No. 30330/1972 and the U.S. Pat. No. 3,871,882, can be mentioned:

General Formula [IX]

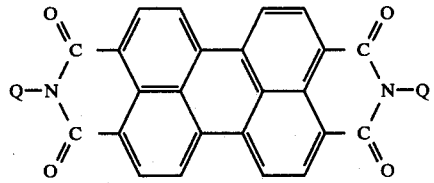

Wherein, Q represents alkyl group, aryl group, alkylaryl group, alkoxy group, heterocyclic substituted group or halogen atom.

General Formula [X]

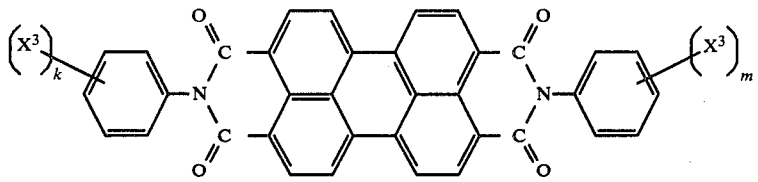

Wherein, $X^3$ represents chlorine atom or methoxy group and k and m independently represent an integer of 0 to 5.

As for quinoline pigments, for example, quinoline pigment as shown in the general formula [XI] below, which has been described in the Japanese Patent Publication Open to Public Inspection No. 1231/1974, is used in the invention.

General Formula [XI]

$$[X^4-CH=(CH-CH)_l=X^4]^{\oplus}Y^{3\ominus}$$

Wherein, $Y^3$ represents iodine atom or bromine atom, $X^4$ represents quinoline ring, l represents an integer of 0, 1, 2 or 3.

As for cyanine pigments, for example, the ones as shown in the general formula [XII] below, which have been described in the Japanese Patent Publication Open to Public Inspection No. 27544/1972, can be mentioned.

General Formula [XII]

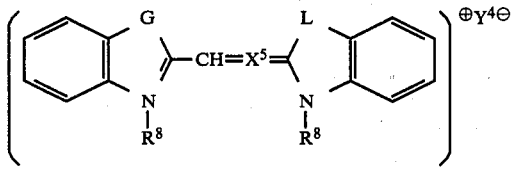

Wherein, $R^8$ represents methyl group, ethyl group or allyl group; $Y^4$ represents chlorine atom, bromine atom, or iodine atom; G and L independently represent oxygen atom, sulfur atom or selenium atom; $X^5$ represents the following:

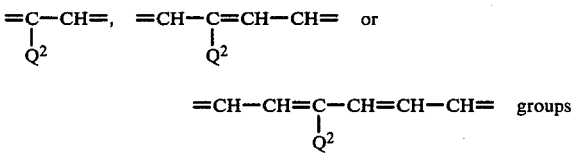

wherein, $Q^2$ represents hydrogen atom, methyl group, or ethyl group.

As for pyrylium salt pigments, for example, the ones as shown in the general formula [XIII] below, which have been described in the Japanese Patent Examined Publications No. 22519/1971 and 22518/1971, can be mentioned:

General Formula [XIII]

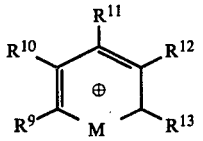

$Z^2$

Wherein, $R^9$, $R^{10}$, $R^{11}$, $R^{12}$ and $R^{13}$ independently represent hydrogen atom, aliphatic or aromatic group preferably having one to fifteen carbon atoms, for example, alkyl group such as methyl, ethyl, propyl, isopropyl, butyl, t-butyl, amyl, isoamyl, hexyl, octyl, nonyl, dodecyl, styryl, methoxystyryl, diethoxystyryl, dimethylaminostyryl, 1-butyl-4-p-dimethylaminophenyl-1.3-butadienyl, β-ethyl-4-dimethylaminostyryl, etc,; alkoxy group such as methoxy, ethoxy, propoxy, butoxy, amyloxy, hexoxy, octoxy, etc.; phenyl, 4-diphenyl, alkylphenyls (4-ethylphenyl, 4-propylphenyl, etc.), alkoxyphenyl (4-ethoxyphenyl, 4-methoxyphenyl, 4-amyloxyphenyl, 2-hexoxyphenyl, 2-methoxyphenyl, 3,4-dimethoxyphenyl, etc.), β-hydroxyalkoxyphenyls (2-hydroxyethoxyphenyl, 3-hydroxyethoxyphenyl, etc.), 4-hydroxyphenyl, halophenyls (2,4-dichlorophenyl, 3,4-dibromophenyl, 4-chlorophenyl, 2,4-dichlorophenyl, etc.), acidephenyl, nitrophenyl, aminophenyls (4-diethylaminophenyl, 4-dimethylaminophenyl, etc.), and naphthyl; and vinyl, etc.; and wherein, M represents sulfur atom, oxygen atom or selenium atom, and $Z^2$ represents anion functional groups (including perchlorate, fluoroborate, iodate, chlorite, bromide, sulfate, sulfonate, periodate, p-toluen sulfonate, etc.)

Further, a pair of $R^9$ and $R^{10}$, and a pair of $R^{12}$ and $R^{13}$ may be a group of atoms necessary to complete aryl ring to form a pyrylium nucleus.

The photoconductive material to be used in the invention may be coated with a resin such as those used as a binder.

The photoconductive materials as described above is usually dispersed in binder and coated on a conductive support to form a photoconductive layer.

The binder to be used in the invention may be any of known binders which are soluble in the removing solution herein described and to which developing agent (i.e., toner) is insoluble, and an organic binder having either low or high molecular weight may be used.

The binder to be used in the invention are desirably of alkaline soluble, particularly phenol resins are preferable as they are capable of satisfying the advantages (1) through (5) given hereinbefore.

As phenol resins to be used in the invention those which can be obtained by making condensation of at least one kind of substituted phenols with aliphatic or aromatic aldehyde can be mentioned. Wherein substituted phenols include, for example, phenol, o-cresol, m-cresol, p-cresol, ethylphenol, isopropylphenol, t-butylphenol, t-aminophenyl, hexylphenol, t-octyl-phenol, cyclohexylphenol, 3-methyl-4-chlor-6-t-butylphenol, isopropylcresol, t-butylcresol, t-amylcresol, hexylcresol, t-octylcresol, cyclohexylcresol, etc.; and said aliphatic and aromatic aldehydes include, for example, as folmaldehyde, acetoaldehyde, acrolein, crotonaldehyde, furfural, etc. Also, polyhydroxyphenyl resins, which can be obtained by polycondensing pyrogallol or resorcinol with acetone, can be used. The preferable ones among said phenol resins are novolak resins which can be obtained by condensing at least one kind of phenol, o-cresol, m-cresol or p-cresol with folmaldehyde or acetoaldehyde under the acidic conditions.

The average molecular weight of said phenol resins may vary approximately from 350 to 20,000 and preferably from 350 to 6,000. It is desirable that said phenol resins are soluble in organic solvents such as ketones (e.g., acetone, methylethylketone, methylisobutylketone, cycloethylketone, etc.), glycolethers (such as ethyleneglycol monomethylether, ethyleneglycolomonoethylether, 2-methoxyethyl acetate, dioxane, etc.) and esters (such as butyl acetate, ethyl acetate, etc.).

The original plate for printing use of the invention can be prepared by mixing 1 part by weight of photoconductive material and 0.01–100 parts by weight of binder (preferably, within the range that photoconductive layer can be dissolved and removed by alkaline solution) in above mentioned organic solvent, into which further electron acceptable compound or electron donatable compound may optionally be added therein with the amount within the range of 0.01–100 mol (preferably, 0.01–10 mol) to pigment, dispersing said mixture homogeneously by means of ball mill or ultra sonic dispersing machine, etc., coating thus photosensitive composition on an electroconductive support with the thickness of 1–50$\mu$, preferably 1–15$\mu$, and drying the coating and then effecting heat treatment thereto before said photoconductive layer is processed with the removing solution, preferably at the time of fixing, so that the percentage of dissolved amount of photoconductive layer in the removing solution may be 80% or higher.

As the electroconductive support to be used in the invention, such an electroconductive support having a hydrophilic surface is used, of which examples are aluminium plate, aluminium laminated resin, or zinc plate, bimetal plate such as copper-aluminium plate, copper-stainless steel plate, chrome-copper plate, etc., or, trimetal plate such as chrome-copper-aluminium plate, chrome-lead-iron plate, chrome-copper-stainless steel plate, etc.

Further, particularly when a support having aluminium surfaces is used, it is preferable that the surface is treated by graining process, anodic oxidizing process, or dipping process with a solution containing sodium silicate, potassium fluorozirconate or phosphate, etc., and so on. And the aluminium plate being processed by dipping with sodium silicate containing solution after graining as described in the U.S. Pat. No. 2,714,066, and the one being processed by dipping in alkaline metal silicate containing solution after anodic oxidation process carried out on aluminium plate as described in the Japenese Patent Examined Publication No. 5125/1972 may also be suitably used. Said anodic oxidation process is put into practice by effecting electric current using aluminium plate as the anode in electrolyte aqueous or non-aqueous solution either singly or in combination, which solution containing inorganic acid such as, for example, phosphoric acid, chromic acid, sulfuric acid, boric acid, etc., or organic acid such as oxalic acid, sulfamine acid, etc., or their salts.

Further, silicate electrodeposition method as described in the U.S. Pat. No. 3,658,662, and polyvinylsulfonic acid processing as described in the West German OLS Patent No. 1621478 is also suitable therefor.

These hydrophilic processings are, besides the performance to make the surface of support hydrophilic, performed to prevent from a harmful reaction with a photosensitive layer coated on said support, or to increase the adhesiveness of photoconductive layer to the support.

And, in the invention, an alkaline soluble intermediate layer, which is composed of casein, polyvinylalcohol, ethylcellulose, phenol resin, stylene-maleinic acid anhydrous copolymer, polyacrylic acid, etc., may optionally be arranged between said electroconductive support and a photoconductive layer for the purpose of improving adhesiveness of photoconductive layer to the support, or electrostatic characteristics of photosensitivity.

Further, in the invention, an over-coating layer, which is dissolved when photoconductive layer is removed, can be arranged onto said photoconductive layer if necessary, for the purpose of improving electrostatic characteristics of photoconductive layer, developing characteristics when toner developing is performed or image characteristics.

The developer (i.e., toner) to be used in the invention is desirably hydrophobic and ink-acceptable and it includes macromolecular substances such as, for example, polystylene resins, polyester resins (amino group containing acrylester, long chain acrylester, etc.), acryl resins (resins having phenol hydroxyl group or sulfonic group, etc.), epoxy resins, vegetable oil denatured alkyd, cyclorubber, asphalt, vinylchloride, etc. And the toner may contain, to the extent that toner granulation and fixation are not affected, coloring agent such as, for example, carbon black, nigrosine pigments, carmine 6B, phthalocyanine blue, benzidine yellow, phthalocyanine green, etc., and, in addition, electric charge controlling agent such as, for example, metallic salt of fatty acid or naphthenic acid, metal containing dye, sulfonate, etc., can be contained in said developing agent (i.e., toner).

Photoconductive layer removing solution (removing solution) used in the invention is a processing solution by which developing agent (toner) is not dissolved and photoconductive layer is dissolved and removed, and said solution may be either alkaline aqueous solution such as sodium silicate containing aqueous solution, organic solvent such as ethyleneglycol, glycerol, methanol or ethanol, or, a mixture thereof. Processing solution to be preferably used in the invention is, for example, alkaline water solution having the pH value of 12–13.

A toner image may be obtained using the original plate of the invention, according to any conventionally known electrophotographic process, in which process the light source may be xenon lamp, halogen lamp, tungsten lamp or fluorescent lamp, etc. Further, the exposure may be effected by means of laser beam from semiconductor laser or, Ar+ or He-Ne laser, etc. The exposure may be effected through transparent positive film. In addition, a toner image can also be obtained by utilizing "so called" a photoconductive memory.

After obtaining a toner image heat fixing is usually effected by means of hot plate, heat roller or heat wire, and thereafter non-image portion (i.e., the portion where no toner adhered) is soaked in the removing solution such as alkaline aqueous solution such as sodium silicate or sodium phosphate containing solution, or organic solvent such as benzyl alcohol and ethyleneglycol monobutyl ether or a mixture of alkaline aqueous solution and organic solvent, each of said solution may additionally contain a surface active agent to dissolve and remove said non-image portion. And thus on the area where toner adheres remains on the surface of the support to form a printing plate of the invention. In the fixing process, burning of photoconductive layer may also be made if needed.

Also, for the purpose of increasing the solubility of photoconductive layer by the aid of exposure be made all over the surface after forming a toner image, quinonediazide compounds (e.g., o-naphthoquinone diazide) or diazo compound can be contained in the photoconductive layer of the original plate for printing use of the invention.

Further, by the use of the original plate of the invention, it is possible to prepare a printing plate for either positive to positive or negative to positive use by utilizing electric charging of both polarities and a single developing agent, that is a very useful plate making method from a practical point of view.

By the use of the invention, a printing plate (a planographic plate or relief press plate) having a high resolution power and a great printing durability (printing durability: approximately 100,000 sheets) can be obtained after forming a toner image and by applying corrosion process and with a small quantity of light (at several ten erg/cm), and besides, (1) a contact film for printing plate use or a micro-film can be produced by making use of a transparent support, and (2) a printed circuit can be produced by making use of an electroconductive support, those of which are the industrial advantages.

The following are the concrete description of the invention referring to the examples, but the embodiments of the invention are not limited thereby.

EXAMPLE 1

| | |
|---|---|
| β-type copper phthalocyanine pigment chromophthal blue 4GN (Chromophthal Blue 4GN made by Ciba Geigy) | 1 part by weight |
| m-cresolformaldehyde resin | 6 parts by weight |
| Ethyleneglycol monoethylether | 30 parts by weight |

The above composition was dispersed by means of glass beads for ten minutes and then was coated by using a wire bar on an aluminium plate, of which surface has been ground and processed by anodic oxidation and sealing, at about 0.25 mm thickness so that the dried weight may be at about 55 mg/dm$^2$. Thus prepared original plate for printing use was then dried for about five minutes in an oven which is heated in advance at 90° C., and is then heated to dry up for one day in a dryer at 50° C., and thus a sample which was not yet according to the invention was prepared.

Corona discharging is made on said sample in a dark place so that the surface potential thereof can become at +130 V, and a negative image is exposed (40 lux. second) by means of tungsten light, and then reversal development is made with Mitsubishi Diafax Master LOM-ED Toner (made by Mitsubishi Paper Mill Co.), and thereupon a very clear positive image was obtained on said original plate for printing use.

Next, said sample is treated by heat for one minute at 120° C. to make a sample according to the invention, and then non-image portion of the photoconductive layer was removed by soaking it into fifteen times diluted solution of DP-1 (produced by Fuji Photo Film Co.: a sodium silicate containing solution). As a result thereof, a planographic printing plate which gave a clear printing image without any "dye stain" was produced.

On the other hand, with regard to the sample not having been treated by heat at 120° C. for one minute, that is, the sample which is not according to the invention, it was not easy to remove the portion of photoconductive layer where toners did not adhere, and highly alkaline concentrated solution had to be used to remove said non-image portion and under such conditions, such as inconvenience that photoconductive layer of image portion was also removed off.

EXAMPLE 2

Samples obtained in the same manner as in the example 1 but the heat treatment according to the invention, were respectively treated by heat for one minute in an oven at temperatures of 40° C., 50° C., 60° C., 70° C., 80° C., 90° C., 100° C., 110° C., 120° C., 140° C. and 160° C., and then these samples were respectively soaked in 20 times diluted solution of said DP-1, and thus the solubility of the photoconductive layer in alkaline solution was measured. In this Example the heat treatment was effected with respect to each sample under following different conditions;

[a] immediate treatment was effected immediately after obtaining the sample

[b] the treatment was effected immediately before the sample was exposed to light (the sample had been stored for ten days), and

[c] the treatment was effected during fixing process, as the case of Example 1.

As the result which is illustrated with reference to the drawing, it was proved that the dissolved amount in alkaline solution was increased by 80% or more when the sample was heat treated at more than 70° C. and at less than 160° C. in any case of the above conditions [a], [b] and [c]. Consequently, it can be proved thereby that the effective temperature for said heat treatments is more than 70° C. and less than 160° C.

Further the heat treatment under condition [a] was effected each of the samples shown in the table 1 below. After corona charging is effected on these samples at a ±6 KV using Electrostatic Paper Analyzer SP-428 (Manufactured by Kawaguchi Denki Seisakusho, K. K.), the dark decay ratio, which is decaying amount of potential in the dark on the surface of the samples in five seconds after charging, was measured. As the result, it was found that the dark decay ratio was increased when heat treatment was effected before developing process. This fact means that heat treatment affects on the electric charge retaining characteristics of the original plate if said treatment is carried out, and that said heat treatment is desirably made in the course of development or fixing after development process.

TABLE 1

| | Sample before heat treatment | | Sample after heat treatment | |
|---|---|---|---|---|
| Sample | + | − | + | − |
| 1 | 37.6 | 38.8 | 48.3 | 51.9 |
| 2 | 34.7 | 38.5 | 38.8 | 46.5 |

TABLE 1-continued

| Sample | Sample before heat treatment + | Sample before heat treatment − | Sample after heat treatment + | Sample after heat treatment − |
|---|---|---|---|---|
| 3 | 38.8 | 42.9 | 50.0 | 54.8 |

Sample 1: Sample obtained in Example 1

Sample 2: Sample produced in the same manner as in Example 1, except that Irgazin Blue 3GT (C.I. No. 74100 produced by Ciba Geigy) instead of chromophthal blue 4GN was used.

Sample 3: Sample produced in the same manner as in Example 1, except that ε type copper phthalocyanine instead of chromophthal blue 4GN (β-type copper phthalocyanine) was used.

BRIEF DESCRIPTION OF THE FIGURE

The FIGURE is a graph exhibiting the amounts of dissolved photoconductive layer in alkaline solution as shown in Example 2, in relation to various heating temperatures.

What is claimed is:

1. A photoconductive plate for printing use having imaged and non-imaged portion, said photoconductive plate comprising an electroconductive support and a photoconductive layer, which photoconductive layer includes a photoconductive material and a binder, A. said photoconductive material comprising an organic photoconductive pigment selected from the group consisting of:

$$(C_8H_4N_2)Rn \qquad (I)$$

wherein, R is hydrogen, deuterium, sodium, potassium, copper, silver, beryllium, magnesium, calcium, zinc, cadmium, barium, mercury, aluminum, gallium, indium, lanthanum, neodymium, samarium, europium, dysprosium, holmium, erbium, thulium, ytterbium, vanadium, antimony, chromium, molybdenum, uranium, manganese, iron, cobalt, nickel, rhodium, palladium, osmium or platinum; and n is an integer of 0 to 2;

II.

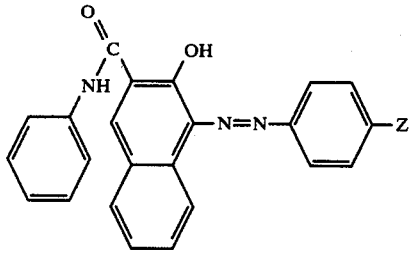

wherein Z is $-NO_2$, —CN, —Cl, —Br, —H, $-CH_3$, $-OC_2H_5$, —OH, or $-N(C_2H_5)_2$;

III.

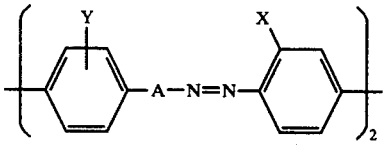

wherein A is

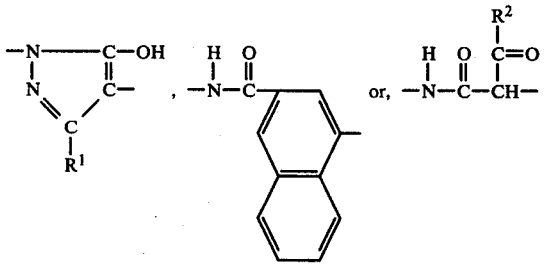

wherein $R^1$ and $R^2$ independently represent a lower alkyl group, and X and Y are independently $-NO_2$, —CN, —H, $-CH_3$, $-OCH_3$, $-OC_2H_5$, —OH, —Cl, —Br, or $-N(C_2H_3)_2$;

IV.

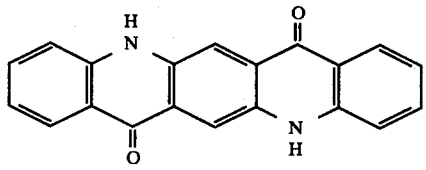

V.

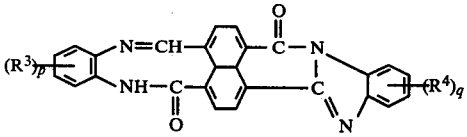

VI.

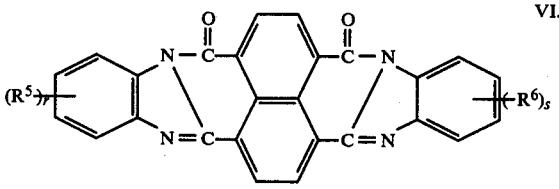

wherein $R^3$, $R^4$, $R^5$ and $R^6$ independently represent substituents selected from the group consisting of an alkyl group, a substituted alkyl group, an aryl group, a substituted aryl group, halogen, a nitro group, and an amino group, p, q, r, s, independently represent an integer of 0 to 4 and when either p, q, r or s is 2 or more, said substituents may be the same or different from each other, and the substituted groups $R^3$, $R^4$, $R^5$ and $R^6$ may be fused to form a benzene nucleus;

VII.

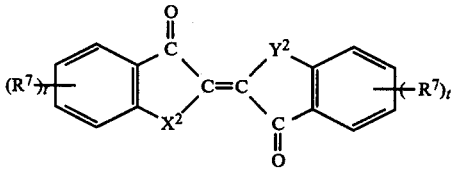

VIII.

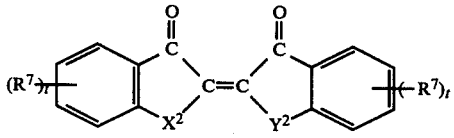

in which $R^7$ is an alkyl group, aryl group, amino group or halogen atom, and $X^2$ and $Y^2$ are independently —NH—, —O—, —S—, —Se—, or —Te—; and t represents an integer of 1 to 4;

IX.

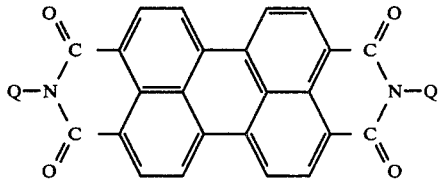

wherein Q is an alkyl group, aryl group, alkyaryl group, alkoxy group, heterocyclic substituted group or halogen atom;

X.

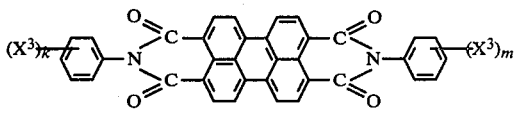

wherein $X^3$ is a chlorine atom or methoxy group and k and m independently represent an integer of 0 to 5;

$$[X^4-CH=(CH-CH)_l=X^4]^{\oplus}Y^{3\ominus} \quad \text{XI.}$$

wherein $Y^3$ is an iodine or bromine atom, $X^4$ represents a quinoline ring, and l represents an integer of 0, 1, 2 or 3;

XII.

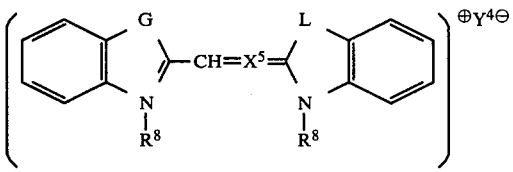

wherein $R^8$ is methyl, ethyl, or allyl; $Y^4$ is chlorine, bromine, or iodine; G and L are independently oxygen, sulfur or selenium; $X^5$ is:

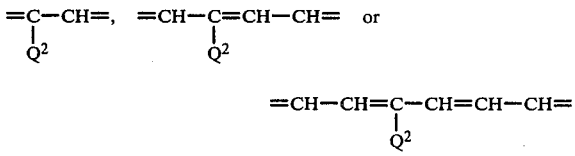

wherein $Q^2$ is hydrogen, methyl, or ethyl; and

XIII.

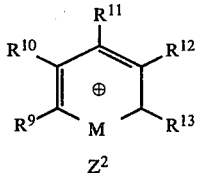

wherein $R^9$, $R^{10}$, $R^{11}$, $R^{12}$ and $R^{13}$ are independently hydrogen, aliphatic or aromatic groups having one to fifteen carbon atoms, alkoxy groups, or vinyl and wherein M is sulfur, oxygen or selenium, and a pair of $R^9$ and $R^{10}$, and a pair of $R^{12}$ and $R^{13}$ may be a group of atoms necessary to complete a aryl ring to form a pyrylium nucleus; and $Z^2$ represents anion functional groups; and B. said binder comprising an alkaline soluble phenol resin obtained by condensation of an aldehyde and at least one of phenol, O-cresol, m-cresol, and p-cresol; said photoconductive plate having been subjected, to inhibit formation of fog in non-imaged portions of said plate, to heat treatment at a sufficiently elevated temperature prior to removal of portions of said photoconductive layer so that at least 80% by volume of the non-imaged portions of the photoconductive layer is removed when said photoconductive plate is subjected to treatment with a removing solution.

2. A photoconductive plate according to claim 1 wherein said photoconductive material is a phthalocyanine pigment represented by the general formula [I] below;

$$(C_8H_4N_2)_4Rn \quad \text{[I]}$$

wherein, R is hydrogen atom, deuterium, sodium, potassium, copper, silver, beryllium, magnesium, calcium, zinc, cadmium, barium, mercury, aluminum, gallium, indium, lanthanum, neodymium, samarium, eutopium, dysprosium, holmium, erbium, thulium, ytterbium, vanadium, antimony, chromium, molybdenum, uranium, manganese, iron, cobalt, nickel, rhodium, palladium, osmium or platinum; and n is an integer of 0 to 2.

3. A photoconductive plate according to claim 2 wherein said phthalocyanine pigment is a non-metallic phthalocyanine of either $\alpha$, $\beta$, $\gamma$, $\pi$, $\chi$ or $\epsilon$ type, or a metallic phthalocyanine of copper, nickel, cobalt, lead or zinc.

4. A photoconductive plate according to claim 1 wherein said electroconductive support is an aluminium plate or resin laminated aluminium plate.

5. A photoconductive plate according to claim 1 wherein said photoconductive layer removing solution is an alkaline solution, an organic solvent or a mixture thereof.

6. A method for preparing a printing plate in which the occurrence of fog in the non-image portions of said plate is inhibited, using a photoconductive plate which comprises a photoconductive layer including a photoconductive material and a binder on an electroconductive support, A. said photoconductive material comprising an organic photoconductive pigment selected from the group consisting of:

$$(C_8H_4N_2)Rn \quad \text{I.}$$

wherein, R is hydrogen, deuterium, sodium, potassium, copper, silver, beryllium, magnesium, calcium, zinc, cadmium, barium, mercury, aluminum, gallium, indium, lanthanum, neodymium, samarium, europium, dysprosium, holmium, erbium, thulium, ytterbium, vanadium, antimony, chromium, molybdenum, uranium, manganese, iron, cobalt, nickel, rhodium, palladium, osmium or platinum; and n is an integer of 0 to 2;

II.

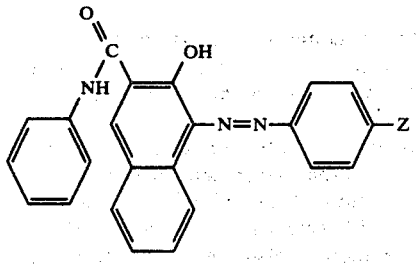

wherein Z is $-NO_2$, $-CN$, $-Cl$, $-Br$, $-H$, $-CH_3$, $-OC_2H_5$, $-OH$, or $-N(C_2H_5)_2$;

III.

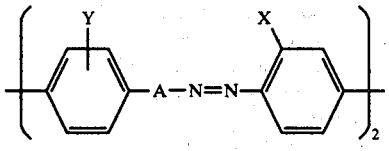

wherein A is

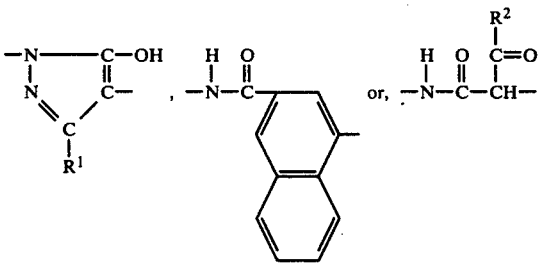

wherein $R^1$ and $R^2$ independently represent a lower alkyl group, and X and Y are independently $-NO_2$, $-CN$, $-H$, $-CH_3$, $-OCH_3$, $-OC_2H_5$, $-OH$, $-Cl$, $-Br$, or $-N(C_2H_3)_2$;

IV.

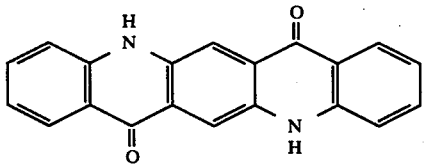

V.

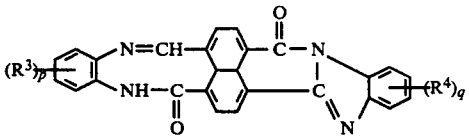

VI.

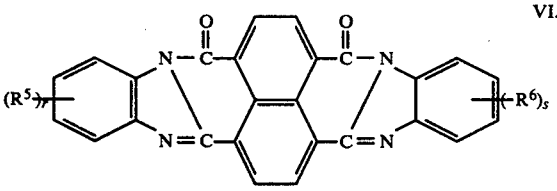

wherein $R^3$, $R^4$, $R^5$ and $R^6$ independently represent substituents selected from the group consisting of an alkyl group, a substituted alkyl group, an aryl group, a substituted aryl group, halogen, a nitro group, and an amino group, p, q, r, s, independently represent an integer of 0 to 4 and when either p, q, r or s is 2 or more, said substituents may be the same or different from each other, and the substituted groups $R^3$, $R^4$, $R^5$ and $R^6$ may be fused to form a benzene nucleus;

VII.

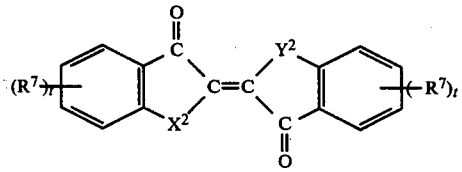

VIII.

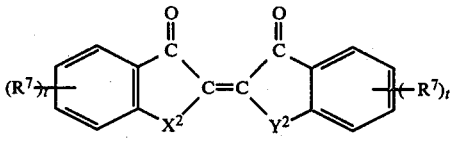

in which $R^7$ is an alkyl group, aryl group, amino group or halogen atom, and $X^2$ and $Y^2$ are independently —NH—, —O—, —S—, —Se—, and —Te—; or t represents an integer of 1 to 4;

IX.

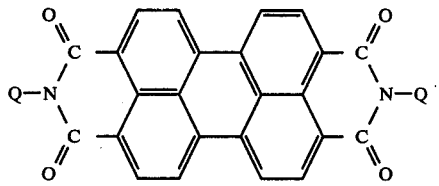

wherein Q is an alkyl group, aryl group, alkyaryl group, alkoxy group, heterocyclic substituted group or halogen atom;

X.

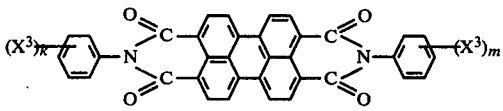

wherein $X^3$ is a chlorine atom or methoxy group and k and m independently represent an integer of 0 to 5;

$$[X^4-CH=(CH-CH)_l=X^4]^{\oplus}Y^{3\ominus} \qquad \text{XI.}$$

wherein $Y^3$ is an iodine or bromine atom, $X^4$ represents a quinoline ring, and l represents an integer of 0, 1, 2 or 3;

XII.

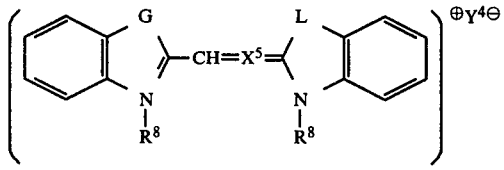

wherein $R^8$ is methyl, ethyl, or allyl; $Y^4$ is chlorine, bromine, or iodine; G and L are independently oxygen, sulfur or selenium; $X^5$ is:

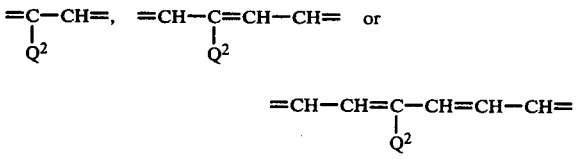

wherein $Q^2$ is hydrogen, methyl, or ethyl; and

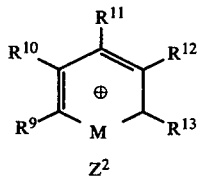

XIII.

wherein $R^9$, $R^{10}$, $R^{11}$, $R^{12}$ and $R^{13}$ are independently hydrogen, aliphatic or aromatic groups having one to fifteen carbon atoms, alkoxy groups, or vinyl and wherein M is sulfur, oxygen or selenium, and a pair of $R^9$ and $R^{10}$, and a pair of $R^{12}$ and $R^{13}$ may be a group of atoms necessary to complete a aryl ring to form a pyrylium nucleus; and $Z^2$ represents anion functional groups; and B. said binder comprising an alkaline soluble phenol resin obtained by condensation of an aldehyde and at least one of phenol, O-cresol, m-cresol, and p-cresol;

which method includes forming an image on said photoconductive layer and removing the non-image portion of the photoconductive layer by treating said layer with a removing solution, said photoconductive plate being subjected, prior to removal of said non-image portion of the photoconductive layer, to an elevated temperature sufficient so that at least 80% by volume of the photoconductive layer is removed in said non-image portion when said photoconductive layer is treated with said removing solution.

7. A method according to claim 6 wherein said heating treatment is effected at a temperature at least at 70° C. and less than 160° C.

8. A method according to claim 6 wherein said removing solution is an alkaline solution, organic solvent or a mixture thereof.

* * * * *

UNITED STATES PATENT AND TRADEMARK OFFICE

CERTIFICATE OF CORRECTION

PATENT NO. : 4,357,403

DATED : November 2, 1982

INVENTOR(S) : Fumio Shimada et al.

It is certified that error appears in the above—identified patent and that said Letters Patent is hereby corrected as shown below:

Claim 6, col. 18, line 26, change "and -Te-; or" to --or -Te-; and--.

Signed and Sealed this

Tenth Day of May 1983

[SEAL]

*Attest:*

GERALD J. MOSSINGHOFF

*Attesting Officer*

*Commissioner of Patents and Trademarks*